US005511397A

United States Patent [19]

Makino et al.

[11] Patent Number: 5,511,397

[45] Date of Patent: Apr. 30, 1996

[54] WASHING MACHINE WITH MEANS FOR STORING AND DISPLAYING DATA OF CONTENTS OF WASHING OPERATION

[75] Inventors: Yoshiyuki Makino, Seto; Masahiro Imai, Tajimi, both of Japan

[73] Assignee: Kabushiki Kaisha Toshiba, Kawasaki, Japan

[21] Appl. No.: 234,151

[22] Filed: Apr. 28, 1994

[30] Foreign Application Priority Data

Apr. 28, 1993 [JP] Japan ..... 5-102653

[51] Int. Cl.[6] ..... D06F 33/02

[52] U.S. Cl. ..... 68/12.27

[58] Field of Search ..... 68/12.01, 12.02, 68/12.12, 12.23, 12.27; 134/57 D, 58 D

[56] References Cited

U.S. PATENT DOCUMENTS 4,275,464 6/1981 Schmidt ..... 371/16.4

4,455,653 6/1984 Le Gars et al. ..... 371/16.4

4,628,443 12/1986 Rickard et al. ..... 364/184

4,977,394 12/1990 Manson et al. ..... 340/679

*Primary Examiner*—Philip R. Coe

*Attorney, Agent, or Firm*—Cushman Darby & Cushman

[57] ABSTRACT

A full automatic washing machine includes a non-volatile memory, such as EEPROM, for storing data of contents of the washing operation executed at a plurality of times in the past. A control circuit originates the data during execution of every washing operation. The data stored in the non-volatile memory are read out and displayed when some switches on an operation panel are operated in a specific mode. The displayed data serve to find out the cause for trouble or failure in the washing machine.

10 Claims, 10 Drawing Sheets

*Fig. 3*

| OPERATION COURSE | BEFORE START | WATER SUPPLY 1 | SOAKING | WASH | DRAINAGE 1 | DEHYDRATION 1 | WATER SUPPLY 2 | RINSE 1 | DRAINAGE 2 | DEHYDRATION 2 | WATER SUPPLY 3 | RINSE 2 | DEHYDRATION 3 | FINAL DEHYDRATION | COMPLETION OF COURSE |
|---|---|---|---|---|---|---|---|---|---|---|---|---|---|---|---|
| STANDARD | | | | 12' | | 2' | | 2' | | 2' | | 3' | | 6' | |
| STUBBORN | | | | 11' | | 2' | | 2' | | 2' | | 3' | | 6' | |
| BULK | | | | 12' | | 2' | | 2' | | 2' | | 3' | | 3' | |
| SOFT | | | | 3' | | 1' | | 1' | | 1' | | 1' | | 1' | |
| MANUAL | | | | 15' | | | | | | | | | | | |
| DATA CODE OF TERMINATED STEP | 0 | 1 | 2 | 3 | 4 | 5 | 6 | 7 | 8 | 9 | 10 | 11 | 12 | 13 | 14 |

*Fig. 4*

| UPPER / LOWER | 0 | 1 | 2 | 3 | | 7 |
|---|---|---|---|---|---|---|
| 0 | LATEST MEMORY ADDRESS | | No. 11 | | | |
| 1 | OPERATIVE INFORMATION | No. 6 | | | | |
| 2 | No. 1 | | | No. 17 | | |
| 3 | | | No. 12 | | | |
| 4 | | No. 7 | | | | |
| 5 | No. 2 | | | No. 18 | | |
| 6 | | | No. 13 | | | |
| 7 | | No. 8 | | | | |
| 8 | No. 3 | | | No. 19 | | |
| 9 | | | No. 14 | | | |
| A | | No. 9 | | | | |
| B | No. 4 | | | No. 20 | | |
| C | | | No. 15 | | | |
| D | | No. 10 | | | | |
| E | No. 5 | | | No. 21 | | |
| F | | | No. 16 | | | |

*Fig. 5*

| ITEM / DATA CODE | OPERATION COURSE | TERMINATED STEP | POWER SUPPLY VOLTAGE LEVEL (V) | OPERATING WATER LEVEL | AUTOMATIC WATER LEVEL SETTING | WASH PERIOD (MIN.) | ERROR CONTENTS |
|---|---|---|---|---|---|---|---|
| | 4 bits | 4 bits | 4 bits | 2 bits | 2 bits | 4 bits | 4 bits |
| 0 | MANUAL | BEFORE START | ~89.5 OR BELOW | HIGH | HIGH | 16 | NONE |
| 1 | STANDARD | WATER SUPPLY 1 | 89.5 ~91 | MIDDLE | MIDDLE | 7 | ABNORMAL DRAINAGE |
| 2 | STUBBORN | SOAKING | 91 ~92.5 | LOW | LOW | 2 | OPEND STATE OF ACCESS LID DURING DEHYDRATION |
| 3 | BULK | WASH | 92.5 ~94 | SMALL | SMALL | 3 | TUB UNBALANCE |
| 4 | SOFT | DRAINAGE 1 | 94 ~95.5 | | | 4 | —— |
| 5 | —— | DEHYDRATION 1 | 95.5 ~97 | | | 5 | ABNORMAL WATER SUPPLY |
| 6 | —— | WATER SUPPLY 2 | 97 ~98.5 | | | 6 | ABNORMAL CONDITION OF WATER LEVEL SENSOR |
| 7 | —— | RINSE 1 | 98.5 ~100 | | | 7 | ABNORMAL CONDITION OF MOTOR |
| 8 | —— | DRAINAGE 2 | 100 ~101.5 | | | 8 | ABNORMAL CONDITION OF ROTATIONAL SENSOR |
| 9 | —— | DEHYDRATION 2 | 101.5 ~103 | | | 9 | —— |
| 10 | —— | WATER SUPPLY 3 | 103 ~104.5 | | | 10 | —— |
| 11 | —— | RINSE 2 | 104.5 ~106 | | | 11 | —— |
| 12 | —— | DRAINAGE 3 | 106 ~107.5 | | | 12 | —— |
| 13 | —— | FINAL DEHYDRATION | 107.5 ~109 | | | 13 | —— |
| 14 | —— | COMPLETION OF COURSE | 109 ~110.5 | | | 14 | —— |
| 15 | —— | —— | 110.5~ | | | 15 | —— |

*Fig. 9*

| ADDRESS | 2 | 5 | 2 | 6 | | 2 | 7 |
|---|---|---|---|---|---|---|---|
| DATA | 1 | 4 | 8 | 5 | | A | 1 |
| DATA (BIN) | 0001 | 0100 | 1000 | 01 | 01 | 1010 | 0001 |
| ITEM | COURSE | TERMINATED STEP | POWER SUPPLY VOLTAGE | OPERATING WATER LEVEL | AUTOMATIC WATER LEVEL SETTING | WASH PERIOD | ERROR CONTENTS |
| DATA CODE | 1 | 4 | 8 | 1 | 1 | 10 | 1 |
| SIGNIFICATION | NORMAL COURSE | DRAINAGE 1 | 100 101.5 | MIDDLE | MIDDLE | 10 MINUTES | ABNORMAL DRAINAGE |

WASHING MACHINE WITH MEANS FOR STORING AND DISPLAYING DATA OF CONTENTS OF WASHING OPERATION

BACKGROUND OF THE INVENTION

1. Field of the invention

This invention relates to a washing machine wherein the cause for a failure or other trouble can be readily determined so that the machine can be readily repaired when of the failure or trouble.

2. Description of the prior art

Users generally ask an electrical products shop or maker to repair a washing machine when something is wrong with it. In such a case, a serviceman proceeds to the user's home and obtains some information about the operating condition of the washing machine from the user. Using that information, the repairman inspects and repairs the washing machine. However, it takes much time for the serviceman to understand the cause for the failure when he or she cannot determine the cause only on the basis of the information from the user. Furthermore, the washing machine is sometimes released from the fault condition when the washing machine is operated in an operation mode different from that when the failure occurred. In this case, the washing machine at first operates normally but thereafter, fails again.

SUMMARY OF THE INVENTION

Therefore, an object of the present invention is to provide a washing machine wherein the cause for the failure or trouble can be found so that the machine can be promptly repaired or adjusted.

The present invention provides a washing machine comprising operation control means, a non-volatile memory, memory control means, read out means and displaying means. The operation control means control a washing operation. The non-volatile memory allows data to be written to and read from while, retaining the written data when the power is switched off. The memory control means stores previously executed actual data concerning executed in a plurality of washing operations executed in into the non-volatile memory, where the plurality of washing operations including a normally executed washing operation and an abnormally executed washing operation. The readout means read out the data stored in the non-volatile memory in response to a predetermined external input, and display means display the data read out by the readout means.

According to the above-described arrangement, data relating to washing operations executed at a plurality of times in the past are stored in the non-volatile memory. More specifically, a record of operations of the washing machine is stored in the non-volatile memory. The record help the serviceman or user to find out the cause for the bad condition or failure of the washing machine. When it is necessary to find out the cause for the bad condition or failure, the readout means is operated to read out the data stored in the non-volatile memory, so that the read out data is displayed on the display means. Since the record of operations of the washing machine is obtained from the read out data, the cause for the bad condition or failure can be readily determined.

The data stored in the non-volatile memory may include data concerning one or more of the following items a washing course, a step at which the operation was interrupted, a level of power supply voltage, an operating water level, an automatically set water level and a wash period. If the data pertains to an abnormal washing condition it may further include error contents. Furthermore, the memory control means may store the data of the washing operations when a washing operation is completed, when a power supply switch is turned off, when an error occurs, and when a washing operation is interrupted.

The above-described washing machine may further comprise an operation panel, a plurality of operation switches provided in the operation panel for setting washing conditions, and a display provided in the operation panel for displaying the set washing conditions. The displaying means may comprise a display. The predetermined external input to the readout means may be obtained by operating the operation switches in a specified mode. Since the means for obtaining the external input and displaying means need not be separately provided, the manufacturing cost of the washing machine can be reduced.

The memory control means may comprise stored data originating means and writing means. The stored data originating means converting the contents of the washing operation to data codes for originating the stored data having a predetermined length. The writing means write data each having a predetermined length into the non-volatile memory so that the data is stored in the non-volatile memory. In this arrangement, the writing means may have a pointer area for storing address data in the first of a memory area for storing said plurality of data, a plurality of memory areas provided after the pointer area for storing said plurality of data. Said plurality of data may be stored sequentially in the first to last memory areas respectively. The address of the memory area in which the latest data is stored may be stored in the pointer area. Furthermore, the data is again stored in the first memory area of the non-volatile memory after the data has been stored in the last of said plurality of memory areas. Consequently, the memory areas of the non-volatile memory can be used in a repeated manner and the data of contents of a plurality of washing operations including the latest data can usually be stored in the non-volatile memory.

The display may display four digits, and the washing machine may further comprise display control means for controlling the display. Using display control means, the address of the data read out by the readout means is displayed, using the higher two digits of the display, and the actual data read out by the readout means is displayed using the lower two digits of the display. The display control means may renew the address and the data displayed on the display every time the operation switch is operated when the address and the data are being displayed on the display. In this arrangement, the display control means may control the display so that the first address in the memory area of the non-volatile memory is displayed using the higher two digits. Further the data stored in the first address, which is the address of the area of the most recently stored data, is displayed using the lower two digits when the readout means reads out the data stored in the non-volatile memory. Thus, the memory area address corresponding to most recently stored the data is first displayed on the display. When the address displayed by the higher two digits is renewed, the most recently stored data can be displayed using the lower two digits. Consequently, the latest data can be promptly recognized.

BRIEF DESCRIPTION OF THE DRAWINGS

Other objects, features and advantages of the present invention will become clear upon reviewing the following description of a preferred embodiment thereof, made with reference to the accompanying drawings, in which:

FIG. 3 is a graph showing steps of operation courses and data codes of interrupted or completed steps;

FIG. 4 is a view diagrammatically showing memory areas of a non-volatile memory employed in the washing machine;

FIG. 5 is a graph showing data codes of contents of washing operation to be stored in the non-volatile memory;

FIG. 9 is a graph showing the relation between the displayed contents and the data contents.

DESCRIPTION OF THE PREFERRED EMBODIMENT

Figure 1:
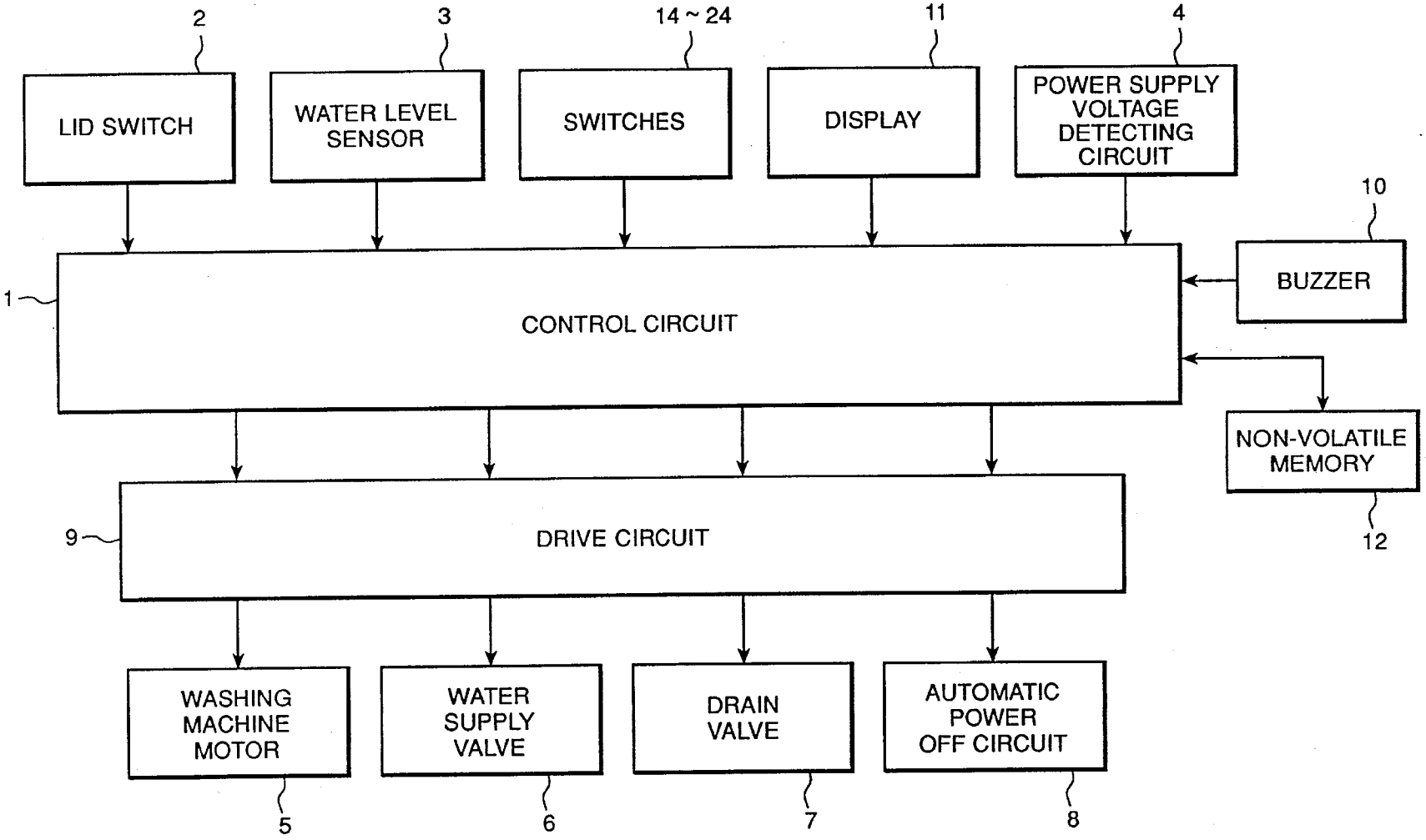
FIG. 1 is a block diagram showing an electrical arrangement of one embodiment of a washing machine in accordance with the present invention.

One embodiment of the present invention will be described with reference to the accompanying drawings. In the embodiment, the invention is applied to a full automatic washing machine. Referring to FIG. 1, a control circuit 1 is composed of a microcomputer storing therein an operation program for controlling the whole operation of the washing machine. The control circuit 1 is supplied with signals from a lid switch 2, a water level sensor 3, switches 14 to 24 which will be described later, and a power supply voltage detecting circuit 4, respectively. Based on these input signals, the control circuit 1 controls a washing machine motor 5, a water supply valve 6, a drain valve 7 and an automatic power-off circuit 8 through a drive circuit 9 in accordance with the operation program. Furthermore, the control circuit 1 is capable of writing data into and reading data out of a non-volatile memory 12 such as an electrically erasable/programmable read only memory (EEPROM). Consequently, the control circuit 1 serves as memory control means, data originating means, writing means, readout means, display control means, as will be described in detail later.

The construction of the washing machine will be briefly described. The full automatic washing machine comprises an outer casing and a water-receiving tub mounted rockably on a suspension mechanism in the outer casing. A rotatable tub serving as a wash tub and a dehydration tub is rotatably mounted in the water-receiving tub. An agitator is rotatably mounted on the bottom of the rotatable tub. The above-mentioned washing machine motor 5 and a drive mechanism are provided on the outer bottom of the rotatable tub. The drive mechanism includes a belt transmission mechanism, a clutch mechanism, reduction gears, and a braking device. Rotational force of the motor 5 is transmitted by the drive mechanism to the agitator in each of wash and rinse operations. The rotational force of the motor 5 is transmitted both to the rotatable tub and to the agitator in a dehydrating operation so that they are rotated at a high speed.

Figure 2:
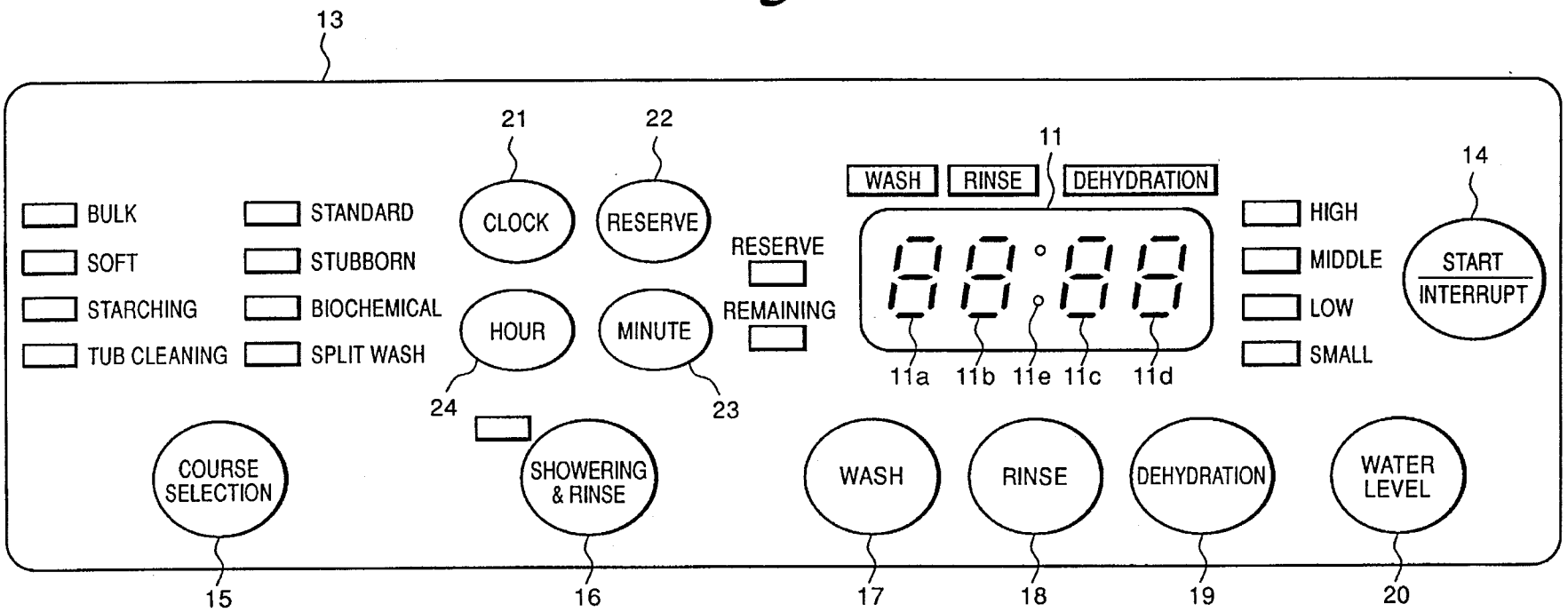
FIG. 2 is a front view of an operation panel of the washing machine.

A top cover is mounted on the top of the outer casing. An operation panel 13 is provided in the front of the top cover, as shown in FIG. 2. As shown, the operation panel 13 includes a start switch an operation course selecting switch 15, a water-supply and rinse mode setting switch 16, a wash period setting switch 17, a rinse time setting switch 18, a dehydrating period setting switch 19, a manually water-level setting switch 20, and switches 21–24. That start switch serves both to start the operation of the washing machine and to interrupt the operation, while switches 21–24 a current time and a reserved period or time. The operation panel 13 further includes a display 11 having four-digit seven-segment numeric display elements 11*a* to 11*d* and a colon display element 11*e*. The display 11 is thus capable of displaying four digits. The display 11 usually displays the current time, the reserved period or time, or a remaining operation period. A plurality of light-emitting diodes are provided on the operation panel 13 for indicating the set operation course, the set water level and the like. These light-emitting diodes are also controlled by the control circuit 1.

Figure 10:
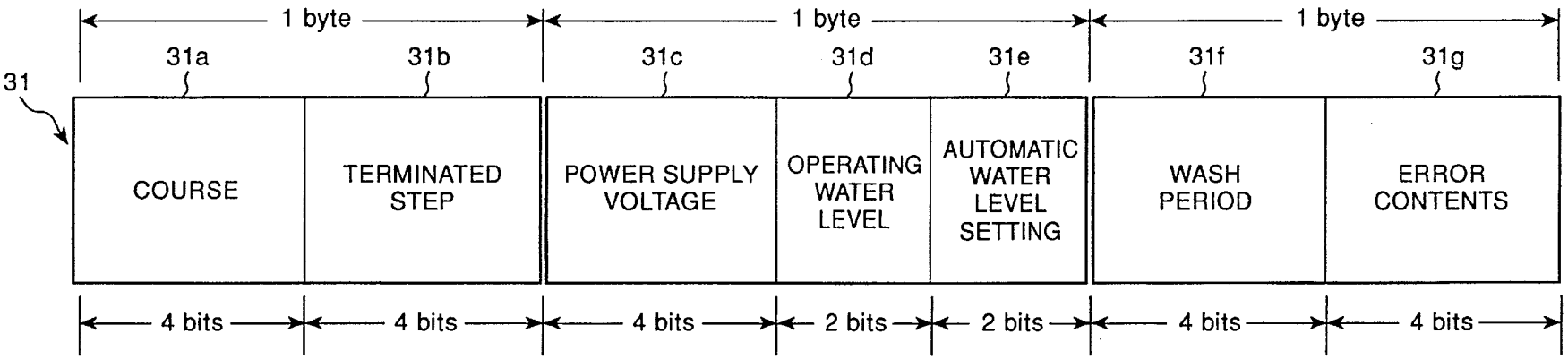
FIG. 10 is a graph showing concrete contents of the stored data.

The operation of the washing machine will be described hereinafter. When the user operates the switches 15 to 20 on the operation panel 13, the control circuit 1 sets the washing operation course on the basis of the signals from the operated switches 15–20. Subsequently, when the user operates the start switch 14, the control circuit 1 starts and controls the washing operation in accordance with the set operation course. During the washing operation, the control circuit 1 converts data relating to the washing operation into data codes or memory data 31 as shown in FIG. 10. The memory data 31 is then written into the non-volatile memory 12 in a manner as will be described later.

The memory data 31 has a predetermined length, for example, three bytes. As shown in FIG. 10, the data 31 includes a 4-bit course memory area 31*a*, a 4-bit terminated step memory area 31*b*, a 4-bit power supply voltage memory area 31*c*, a 2-bit operation water level memory area 31*d*, a 2-bit automatically set water level memory area 31*e*, a 4-bit wash period memory area 31*f*, and a 4-bit error contents memory area 31*g*. Data codes "0" to "15" as shown in FIG. 5 are stored in the memory areas 31*a* to 31*g*. Although the data codes "0" to "15" are represented in the form of decimal numerals, they are stored in the memory areas 31*a*–31*g* in the form of binary numerals. Accordingly, a 4-bit area is sufficient for storing sixteen data codes- "0" to "15", and a 2-bit area is sufficient for storing four data codes- "0" to "3." For example, when "MANUAL WASH" is selected as the operation course, the data code "0" is stored in the first 4-bit area or the operation course memory area 31*a*. The data code "0" is stored in the subsequent 4-bit area or the terminated step memory area 31*b* when "BEFORE START" is selected as the terminated step. Subsequently, the data codes are stored in memory areas in the same manner as described above.

Referring to FIG. 4, the non-volatile memory 12 has a memory area of 128 bytes in the form of a matrix with rows of 16 bytes and columns of 8 bytes. Each byte of the 128 byte memory area shown as each square area in FIG. 4 is addressed by a 1-byte or 8-bit address data. More specifically, the numerals (hexadecimal) "0" to "F" representative of the rows of the memory area are represented by the lower 4 bits of the 8-bit address data. The numerals (hexadecimal) "0" to "7" representative of the columns of the memory area are represented by higher 4 bits of the 8-bit address data.

The above-described memory area is used in the following manner. An area of a first byte indicated by an 8-bit address data "00" is a pointer area. The memory data 31 of the contents of a latest washing operation is stored in one memory area, and address data indicative of a leading address of the memory area is stored in the pointer area. Following the pointer area, a plurality of memory areas are provided for storing a plurality of memory data 31 of the contents of the washing operation respectively. In the embodiment, twenty-one such memory areas are provided as shown in FIG. 4. The memory areas are shown by "No. 1," "No. 2," "Nod. 3," . . . and "No. 21" in FIG. 4. Memory area No. 1 is a 3-byte area beginning with address data "01." Memory area No. 2 is a 3-byte area beginning with address data "04." Memory area No. 21 is a 3-byte area beginning with address data "3D."

The contents of washing operations whose data are stored in the non-volatile memory 12 include a washing course, a terminated step, a power supply voltage level, an operating water level, an automatically set water level, a washing period, and error contents. The washing course includes courses of "STANDARD," "STUBBORN," "BULK," "SOFT," and "MANUAL." The terminated step refers to a step where the washing operation is interrupted or completed. The data 31 does not include all of these contents. One or more of these contents may be selected. Furthermore, items other than those mentioned above may be employed. The above-mentioned error contents include abnormal drainage, opening of an access lid during dehydration, unbalanced state of the tub, abnormal water supply, abnormal state of the water level sensor, and abnormal state of the motor, abnormal state of the rotational sensor. The abnormal drainage is determined by detecting the variations in the water level after the drain valve is opened. The opening of the access lid is determined on the basis of a switch signal from the lid switch during the dehydrating operation. The unbalanced state of the tub is sensed by an unbalance sensor (not shown). The abnormal water supply is determined by the variations in the water level after the water supply valve is opened. The abnormal state of the water level sensor is determined by detecting an abnormal level of a water level detection signal generated by the water level sensor. The abnormal state of the motor is determined on the basis of a rotation detection signal generated by a rotational sensor detecting a rotational speed of the motor after energization thereof. The abnormal state of the rotational sensor is determined by detecting an abnormal state of waveform of the rotation detection signal from the rotational sensor, such as distortion of the waveform.

Figure 6:
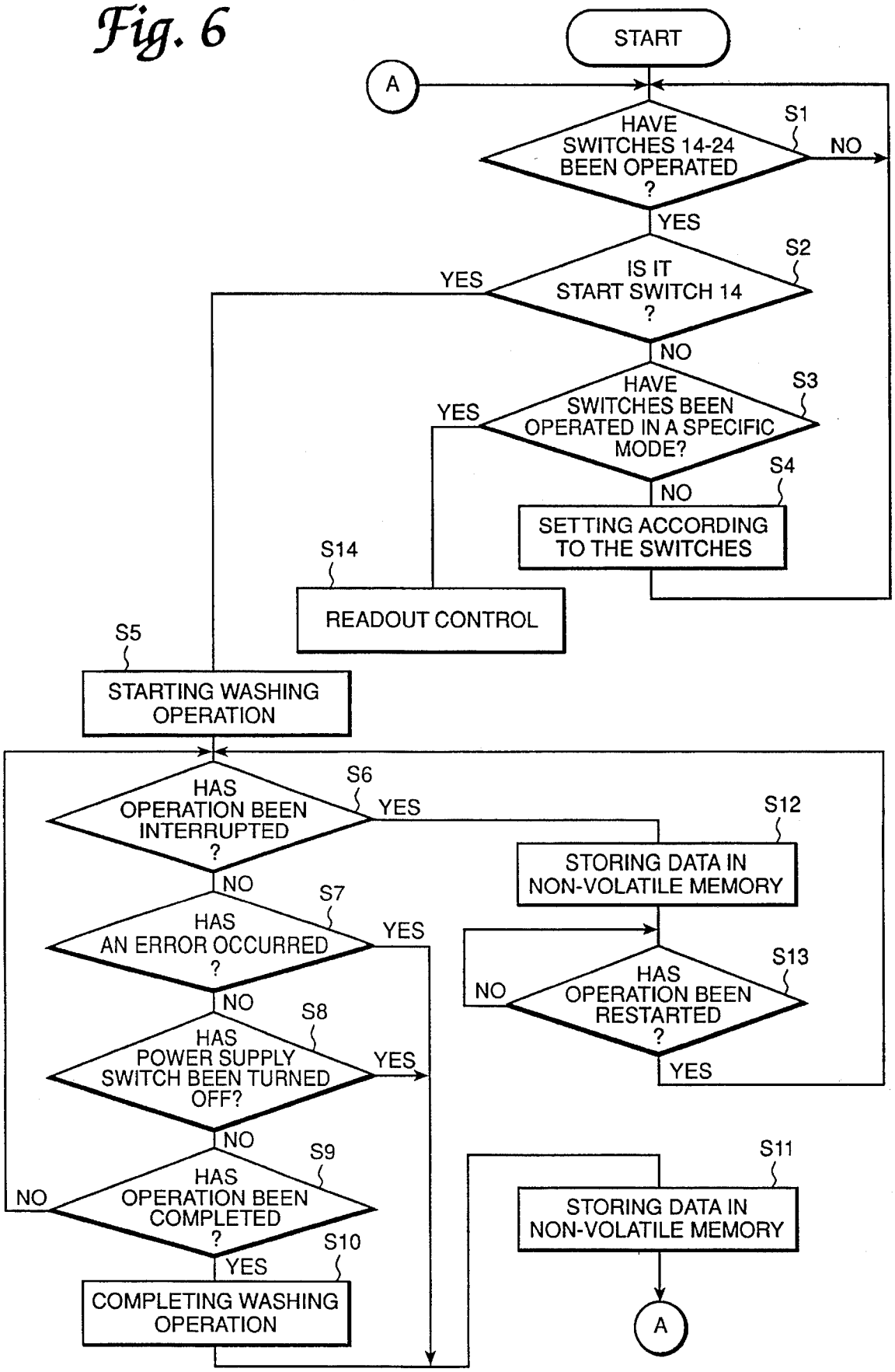
FIG. 6 is a flowchart explaining the control manner of a control circuit employed in the washing machine.
Figure 7:
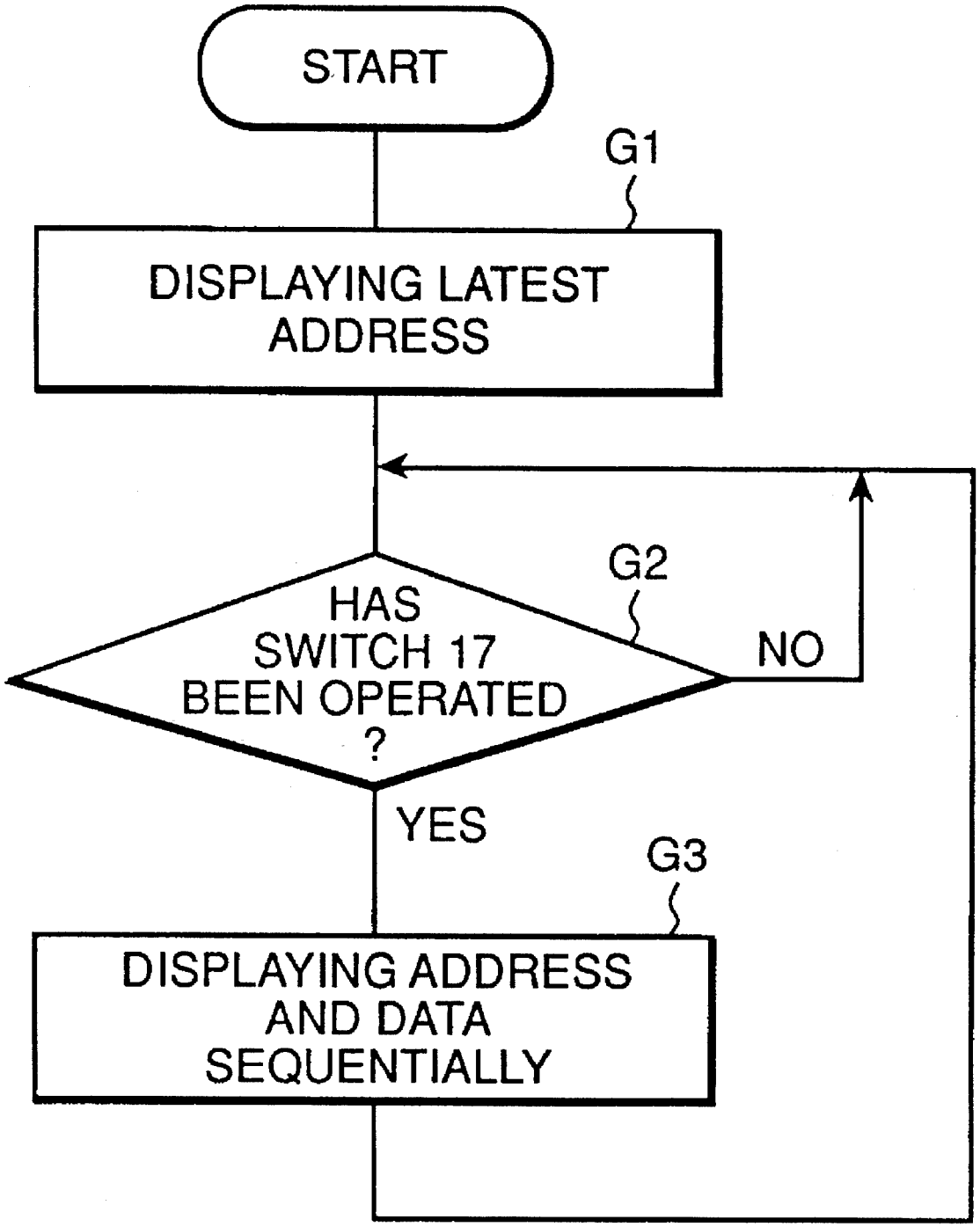
FIG. 7 is a flowchart explaining the data readout operation.

Control manners for storing data in the non-volatile memory 12 and reading the data out of the non-volatile memory will now be described with reference to FIGS. 6 and 7 showing control contents of the control program whose data is stored in the control circuit 1. Referring to FIG. 6, the control starts when a power supply plug (not shown) is connected to a plug socket. First, the control circuit 1 determines whether the switches 14–24 have been operated or not, at step S1. When any one of these switches has been operated, at step S2 the control circuit 1 determines whether the operated switch is the start switch 14. When the operated switch is not the start switch 14, it is determined whether or not the switches have been in a specific mode as will be described later, at step S3. When the switches have not been operated in the specific mode or when any one of switches 15–24 has been operated, the control circuit 1 sets the condition of the washing operation (control contents) selected by the operated switch at step S4, then returning to step S1. Subsequently, steps S1 to S4 are repeated when the other switches 15–24 are operated in accordance with need of the user, so that the conditions of the washing operation desired by the user are set. Thereafter, upon operation of the start switch 14, the washing operation is initiated on the basis of the conditions set as described above (step S5). In this regard, the washing operation is automatically executed in accordance with one of the courses, "STANDARD," "STUBBORN," "BULK," "SOFT," and "MANUAL" and the like, as shown in FIG. 3. When the conditions of the washing operation such as the water level, wash period, water stream mode and the like are manually set, the washing operation is executed in accordance with the manually set conditions.

The control circuit 1 determines about the following three items during execution of the washing operation. That is, in step S6 the control circuit 1 determines whether the washing operation has been interrupted or not. In step S7, the control circuit 1 determines whether an error has occurred or not. At step S8, the control circuit 1 determines and whether a power supply switch (not shown) has been turned off or not. When the washing operation is completed without interruption thereof, occurrence of an error and turn-off of the power supply switch, the control circuit 1 determines in the affirmative at step S9, advancing to step S10 where the washing operation is completed. Furthermore, the control circuit 1 converts the contents of the completed washing operation to data codes, thereby originating the memory data 31. These contents include the course, the terminated step, the power supply voltage level, the operating water level, the automatically set water level, the wash period and the error contents, as described above. The initial memory data 31 is written into memory area No. 1 of the non-volatile memory 12. Simultaneously, the address data "01" indicative of the first address of memory area No. 1 is written into the pointer area. The subsequent memory data 31 of the contents of the washing operation is written into memory area No. 2 and so on. After the memory data 31 is written into memory area No. 21, the memory area No. 1 in which the oldest data 31 is stored is renewed so that the latest data 31 is stored in the area. Thereafter, the above-described data processing is repeated.

On the other hand, the control circuit 1 answers in the affirmative at step S6 when the operation has been interrupted during execution of the washing operation. The control circuit 1 converts the data relating to the washing operation to the data codes until the time of interruption, thereby originating the memory data 31. The originated memory data 31 is stored in the non-volatile memory 12 at step S12. In this case, the memory data 31 is stored in the memory area subsequent to the area in which the last data 31 is stored. Its address data is stored in the pointer area. Subsequently, upon restart of the washing operation, the control circuit 1 answers in the affirmative at step S13, returning to step S6.

Upon occurrence of error during the washing operation, the control circuit 1 answers in the affirmative at step S7. The control circuit 1 converts the contents of the washing operation up to the time of occurrence of the error to the data codes, thereby originating the memory data 31. The originated memory data 31 is stored in the non-volatile memory 12 (step S11). Furthermore, when the power supply switch is turned off during the washing operation, the control circuit 1 answers in the affirmative at step S8. In this case, too, the control circuit 1 converts the contents of the washing operation to the data codes until the power supply switch is turned off thereby originating the memory data 31. The originated data 31 is stored in the non-volatile memory 12 (step S11). Thus, the memory data 31 of the contents of the washing operations are stored in the respective memory areas Nos. 1 to 21 of the non-volatile memory 12 sequentially every time the washing operation is executed, to accumulate a record of the washing operation. The address data indicative of the first of the memory area storing the most recently written memory data 31 is stored in the pointer area indicated by the address data "00."

When the washing machine is in a bad condition or when a failure has occurred in the washing machine, a serviceman inspects the cause for the bad condition or the failure at the user's request. When the switches 15–24 of the operation panel 13 are operated in the specific mode, the data of the contents of the previous washing operation is read out to be displayed on the display 11. For example, when the power supply switch (not shown) is turned on with simultaneous turn-on of the switches 17–19, the control circuit 1 answers in the affirmative at step S3, advancing to step S14 where a subroutine for the data readout control is executed. The subroutine is shown in FIG. 7. In this case, the latest memory data 31 is stored in memory area No. 13 of the non-volatile memory 12.

Figure 8A:
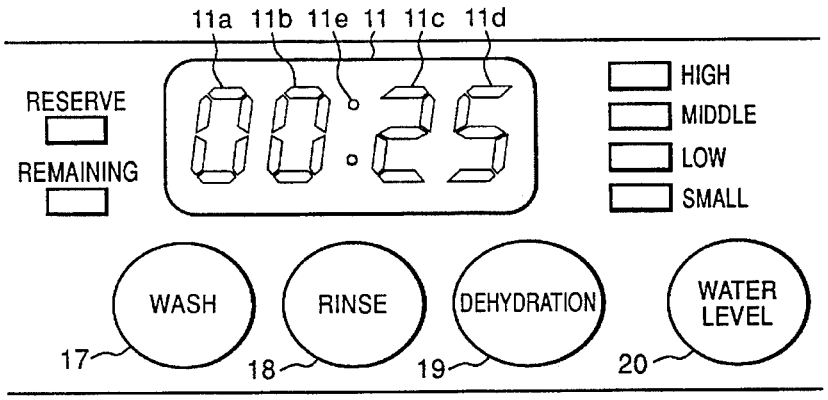
FIGS. 8A to 8D show the contents displayed on the display in a readout control.

Upon execution of the subroutine shown in FIG. 7, the address data "00" of the pointer area is displayed by the higher two digit display elements 11*a* and 11*b* of the display 11 and the data stored in the pointer area. That is, as shown in FIG. 8A (step G1), address data "25" is displayed by lower two digit display elements 11*c* and 11*d* of the display 11 to indicate the first of the memory area in which the latest memory data 31 is stored. Consequently, it is the memory area in which the latest memory data 31 is stored or the address data (address) of the memory area in which the data 31 was written last is "25". When the wash period setting switch 17 is operated in the condition that the above-mentioned data are on display, the control circuit 1 answers in the affirmative at step G2, advancing to step G3. The address data is incremented (renewed) one byte so that the address data "01" is displayed by the higher two digit display elements 11*a*, 11*b*, and the data stored in the displayed address data "01" is displayed by the lower two digit display elements 11*c*, 11*d* (step G3). Thereafter, the control circuit 1 returns to step G2 where the control circuit 1 answers in the affirmative every time the wash period setting switch 17 is operated. Then, at step G3, the address data is incremented one byte so that the incremented address data is displayed by the higher two digit display elements 11*a*, 11*b*, and the data assigned the displayed address data is displayed by the lower two digit display elements 11*c*, 11*d* (step G3). Execution of the subroutine as shown in FIG. 7 is stopped when the power supply plug is pulled out of the plug socket.

Figure 8B:
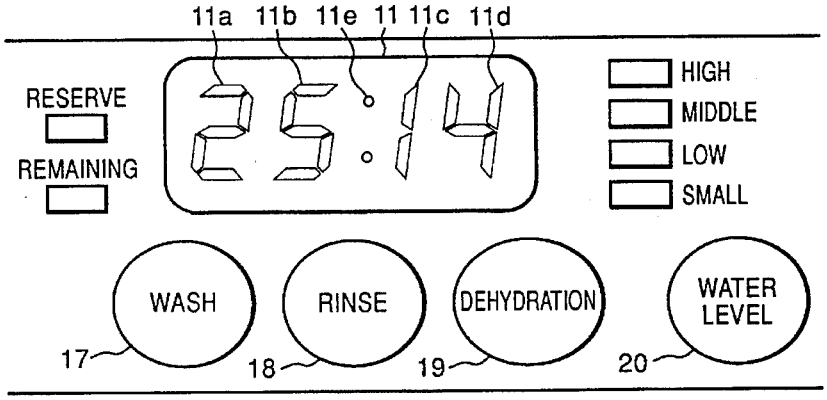

When the contents of the washing operation whose data is stored in the latest memory data 31 are to be examined, the wash period setting switch 17 is operated at a predetermined number of times so that the first address data "25" of the memory area No. 13 is displayed by the higher two digit display elements 11*a*, 11*b*, as shown in FIG. 8B. Then, data "14" is displayed by the lower two digit display elements 11*c*, 11*d*, as shown in FIG. 8B. The displayed data "14" is one byte of data beginning with the forefront of the latest memory data 31. As understood from FIG. 9, the data "14" represents that the executed course is the "STANDARD" course and that the interrupted step is "DEHYDRATION 1."

Figure 8C:
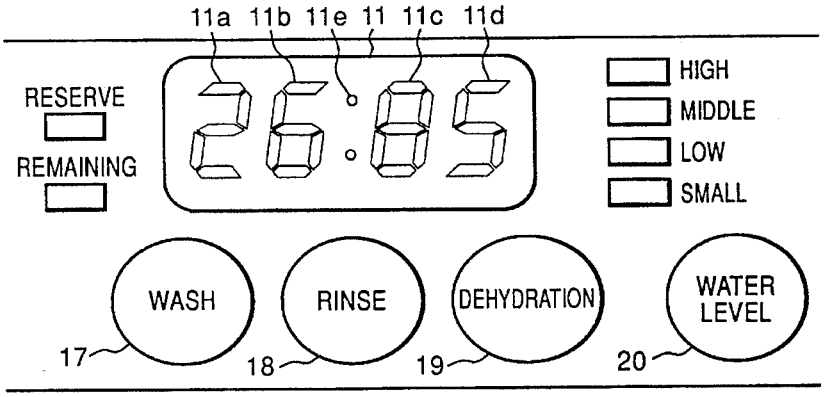

When the wash period setting switch 17 is further operated in the condition as shown in FIG. 8B, the second 1-byte address data "26" of the memory area No. 13 is displayed by the higher two digit display elements 11*a*, 11*b*, as shown in FIG. 8C. Simultaneously, the second 1-byte data "85" of the latest memory data 31 is displayed by the lower two digit display elements 11*c*, 11*d*. As understood from FIG. 9, the data "85" represents that the power supply voltage ranged between 100 and 101.5 V, the operating water level was "MIDDLE," and that the automatically set water level was "MIDDLE" in the executed washing operation.

Figure 8D:
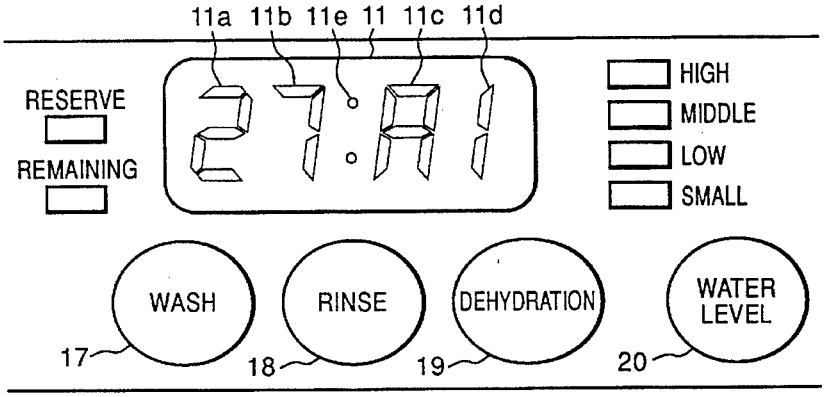

When the switch 17 is further operated in the condition as shown in FIG. 8C, the third 1-byte address data "27" of the memory area No. 13 is displayed by the higher two digit display elements 11*a*, 11*b*, as shown idn FIG. 8D. Simultaneously, the third 1-byte data "A1" of the latest memory data 31 is displayed by the lower two digit display elements 11*c*, 11*d*. As understood from FIG. 9, the data "A1" represents that the wash period was 10 minutes and that the error contents were "ABNORMAL DRAINAGE" in the executed washing operation. The latest memory data 31 is read out and displayed in the manner as described above. Based on the displayed data, the serviceman or the user can find that the drainage became abnormal in the step of "DRAINAGE 1" and that the washing operation was interrupted.

According to the above-described embodiment, the data of contents of the washing operations executed at a plurality of times in the past are stored in the non-volatile memory 12. The switches of the operation panel 13 are operated in the specific mode so that the external input is obtained for reading out the data stored in the non-volatile memory 12. The data are displayed by the display 11. Accordingly, the data of contents of the washing operation can be read from the non-volatile memory 12 to be displayed when the washing machine is out of order or when a failure has occurred in the washing machine. Since the serviceman or user can obtain the record of operation contents of the washing machine from the displayed data, he or she can easily find the cause for the trouble or failure of the washing machine. Empirically, the washing machine is sometimes released temporarily from the trouble or failure at the time of repairs even when the trouble or failure has occurred in the washing machine. In this case, it is difficult to find out the cause for the trouble or failure. Thereafter, the same trouble or failure occurs in the washing machine when it is operated. However, in the above-described embodiment, the cause for the trouble or failure can be easily found out even in such a case since the record of operation contents of the washing machine can be read out to be displayed.

In the foregoing embodiment, the power supply switch (not shown) is turned on with simultaneous turn-on of the switches 17–19, so that the readout and display control for the memory data 31 stored in the non-volatile memory 12 is executed. Accordingly, the readout and display control can be prevented from being inadvertently executed by the user in the usual washing operation. Furthermore, the display 11 is utilized to display the data read out of the non-volatile memory 12. The display 11 is primarily provided for displaying the current time, reserved time or period, and the leftover period. Consequently, the increase in the component parts can be prevented, and the manufacturing cost of the washing machine can accordingly be reduced.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A washing machine comprising:

a) operation control means for controlling a washing operation;

b) a non-volatile memory into which data is recorded and from which the recorded data is read, the non-volatile memory retaining the recorded data when power is turned off;

c) memory control means for recording data relating to a plurality of previously executed actual washing operations into the non-volatile memory, the plurality of washing operations including a normally executed washing operation and an abnormally executed washing operation;

d) readout means for reading out the recorded data in response to a predetermined external input; and e) displaying means for displaying the recorded data read out by the readout means.

2. A washing machine according to claim 1, wherein the data recorded in the non-volatile memory for each normal washing operation includes one or more of a washing course, a step at which the operation was terminated, a level of power supply voltage, an operating water level, an automatically set water level and a wash period, and wherein the data recorded in the non-volatile memory for each abnormal washing operation further includes data relating to the abnormal aspect of the washing operation.

3. A washing machine according to claim 1, wherein the memory control means records data when each of the washing operations is completed, when a power supply switch is turned off, when an error occurs, and when any of the washing operations is interrupted.

4. A washing machine according to claim 1, further comprising an operation panel, a plurality of operation switches provided in the operation panel for setting washing conditions, and a display provided in the operation panel for displaying the set washing conditions, wherein the displaying means comprises the display, and wherein the predetermined external input to the readout means is obtained by operating the operation switches in a specified mode.

5. A washing machine according to claims 1, 2, 3 or 4, wherein the memory control means comprises:

stored data originating means for generating codes having a predetermined length as the data relating to washing operations; and writing means for writing the codes having the predetermined length into the non-volatile memory so that the data are stored in the non-volatile memory.

6. A washing machine according to claim 5, wherein:

the non-volatile memory includes a plurality of memory areas, each for storing one of the data; and the writing means includes a pointer area for storing address data corresponding to one of the plurality of memory areas of the non-volatile memory, wherein the writing means causes the data to be stored sequentially in a first to a last of the memory areas, respectively, and wherein an address of the memory area holding a latest data is stored in the pointer area.

7. A washing machine according to claim 6, wherein the data is again stored in the first memory area of the non-volatile memory after data has been stored in the last of said plurality of memory areas.

8. A washing machine according to claim 7, wherein the display is capable of displaying four digits, the washing machine further comprising display control means for controlling the display so that an address corresponding to data read out by the readout means is displayed by two higher digits of the display, and the data read out by the readout means is displayed by two lower digits of the display.

9. A washing machine according to claim 8, wherein the display control means renews the address and the data displayed on the display every time at least one of the operation switches are operated when the address and the data are being displayed on the display.

10. A washing machine according to claim 9, wherein the display control means controls the display so that the first address in the memory area of the non-volatile memory is displayed by use of the higher two digits and the data stored in the first address, which data is the address of the area in which the latest data is stored, is displayed by use of the lower two digits when the readout means reads out the data stored in the non-volatile memory.

* * * * *